US009955791B2

(12) United States Patent
Chandler et al.

(10) Patent No.: US 9,955,791 B2
(45) Date of Patent: May 1, 2018

(54) CLIMATE CONTROLLED MATTRESS ASSEMBLY AND RELATED METHOD

(71) Applicant: Tempur-Pedic Management, LLC, Lexington, KY (US)

(72) Inventors: Kelly Wood Chandler, Gate City, VA (US); Mark Ewin Wilder, Limestone, TN (US)

(73) Assignee: Tempur-Pedic Management, LLC, Lexington, KY (US)

( * ) Notice: Subject to any disclaimer, the term of this patent is extended or adjusted under 35 U.S.C. 154(b) by 385 days.

(21) Appl. No.: 14/649,987

(22) PCT Filed: Dec. 28, 2012

(86) PCT No.: PCT/US2012/071975
§ 371 (c)(1),
(2) Date: Jun. 5, 2015

(87) PCT Pub. No.: WO2014/105039
PCT Pub. Date: Jul. 3, 2014

(65) Prior Publication Data

US 2015/0289666 A1 Oct. 15, 2015

(51) Int. Cl.
*A47C 21/04* (2006.01)
*A47C 27/10* (2006.01)
(Continued)

(52) U.S. Cl.
CPC ..... *A47C 21/044* (2013.01); *A47C 21/048* (2013.01); *A47C 27/082* (2013.01);
(Continued)

(58) Field of Classification Search
CPC ..... A47C 21/044; A47C 21/048; A47C 27/08; A47C 27/082; A47C 27/10; A47C 27/083; A61G 7/05776
See application file for complete search history.

(56) References Cited

U.S. PATENT DOCUMENTS 4,394,784 A * 7/1983 Swenson ..... A47C 27/082 415/121.3
4,449,261 A * 5/1984 Magnusson ..... A47C 21/044 5/706

(Continued)

FOREIGN PATENT DOCUMENTS

JP 10-174636 * 6/1998
JP 10-174636 A 6/1998

OTHER PUBLICATIONS

Patent Cooperation Treaty, International Search Report and Written Opinion, dated Sep. 5, 2013, 15 pgs.

*Primary Examiner* — Eric J Kurilla
(74) *Attorney, Agent, or Firm* — Middleton Reutlinger

(57) ABSTRACT

Mattress assemblies are provided that make use of air bladders to provide a level of climate control to the mattress assemblies. The mattress assemblies include a body supporting portion having a first surface and a second surface opposite the first surface, an air bladder positioned adjacent to the second surface of the body supporting portion, a frame portion including a bottom surface and a border defining a well for receiving the air bladder, and an air pump that is operably connected to a climate control system for delivering heated or cooled air into the air bladder. A method of controlling the temperature of a mattress assembly is also provided.

7 Claims, 7 Drawing Sheets

(51) Int. Cl.
*A47C 27/08* (2006.01)
*A47C 27/18* (2006.01)

(52) U.S. Cl.
CPC ..... *A47C 27/083* (2013.01); *A47C 27/10* (2013.01); *A47C 27/18* (2013.01)

(56) References Cited

U.S. PATENT DOCUMENTS 4,467,611 A 8/1984 Nelson et al.
4,644,753 A 2/1987 Burke
4,803,744 A * 2/1989 Peck ..... A61B 5/1115 5/706
4,922,721 A 5/1990 Robertson et al.
4,947,500 A 8/1990 Seiler
5,136,850 A 8/1992 Bierschenk et al.
5,249,319 A * 10/1993 Higgs ..... A47C 27/082 5/713
5,367,879 A 11/1994 Doke et al.
5,367,890 A 11/1994 Doke
5,398,510 A 3/1995 Gilley et al.
5,505,046 A 4/1996 Nelson et al.
5,522,216 A 6/1996 Park et al.
5,576,512 A 11/1996 Doke
5,650,904 A 7/1997 Gilley et al.
5,699,570 A 12/1997 Wilkinson et al.
5,737,923 A 4/1998 Gilley et al.
5,850,644 A 12/1998 Hsia
5,860,280 A 1/1999 Recine, Sr. et al.
6,003,319 A 12/1999 Gilley et al.
6,169,245 B1 1/2001 Sharp
6,188,011 B1 2/2001 Nolas et al.
6,207,888 B1 3/2001 Nolas
6,369,314 B1 4/2002 Nolas
6,399,871 B1 6/2002 Sharp
6,492,585 B1 12/2002 Zamboni et al.
6,660,925 B1 12/2003 Sharp
7,531,739 B1 5/2009 Moczygemba
7,619,158 B2 11/2009 Sharp et al.
7,763,792 B2 7/2010 Sharp et al.
7,827,805 B2 11/2010 Comiskey et al.
7,871,847 B2 1/2011 Moczygemba
7,877,827 B2 2/2011 Marquette et al.
7,996,936 B2 8/2011 Marquette et al.
8,104,295 B2 1/2012 Lofy
8,181,290 B2 5/2012 Brykalski et al.
8,222,511 B2 7/2012 Lofy
8,256,236 B2 9/2012 Lofy
8,332,975 B2 12/2012 Brykalski et al.
8,359,871 B2 1/2013 Woods et al.
8,402,579 B2 3/2013 Marquette et al.
8,418,286 B2 4/2013 Brykalski et al.
8,434,314 B2 5/2013 Comiskey et al.
8,438,863 B2 5/2013 Lofy
RE44,272 E 6/2013 Bell
2004/0079407 A1 4/2004 Sharp
2004/0261830 A1 12/2004 Sharp et al.
2006/0107989 A1 5/2006 Bierschenk et al.
2006/0124165 A1 6/2006 Bierschenk et al.
2006/0180192 A1 8/2006 Sharp et al.
2008/0245397 A1 10/2008 Moczygemba et al.
2009/0090409 A1 4/2009 Moczygemba
2009/0090544 A1 4/2009 Rawot et al.
2009/0093078 A1 4/2009 Moczygemba
2009/0106898 A1* 4/2009 Flick ..... A61G 7/05784 5/424
2009/0211619 A1 8/2009 Sharp et al.
2010/0081191 A1 4/2010 Woods
2010/0192299 A1* 8/2010 Schermel ..... A47C 21/048 5/421
2010/0199687 A1 8/2010 Woods et al.
2011/0035880 A1 2/2011 Cole et al.
2011/0271994 A1 11/2011 Gilley
2011/0289684 A1 12/2011 Parish et al.
2011/0302719 A1* 12/2011 Schwirian ..... A61B 5/1115 5/706
2011/0314837 A1 12/2011 Parish et al.
2012/0000207 A1 1/2012 Parish et al.
2012/0319439 A1 12/2012 Lofy
2013/0032189 A1 2/2013 Moczygemba et al.
2013/0086923 A1 4/2013 Petrovski et al.
2013/0097777 A1 4/2013 Marquette et al.
2013/0146116 A1 6/2013 Jovovic et al.
2013/0186448 A1 7/2013 Ranalli et al.
2014/0277778 A1* 9/2014 Nunn ..... A47C 27/083 700/282
2016/0128487 A1* 5/2016 Eskridge, III ..... A47C 21/048 5/423
2017/0224565 A1* 8/2017 Lachenbruch ..... A61G 7/05776

* cited by examiner

CLIMATE CONTROLLED MATTRESS ASSEMBLY AND RELATED METHOD

TECHNICAL FIELD

The present invention relates to climate controlled mattress assemblies and methods for controlling the temperature of mattress assemblies. In particular, the present invention relates to mattress assemblies that make use of an air pump and a climate control system for delivering heated or cooled air to one or more air bladders included in the mattress assemblies.

BACKGROUND

Mattress assemblies that make use of air bladders, which are also known as air beds, are becoming increasing popular as an alternative to traditional mattresses. Unlike traditional mattress assemblies where the firmness of the mattress assemblies are not adjustable, the firmness of a mattress assembly that makes use of an air bladder is readily adjustable by increasing or decreasing the amount of air included in the air bladders that are present within a particular mattress assembly. In other words, by changing the air pressure in the air bladders of such a mattress assembly, a user can readily change the firmness of the mattress assembly and, consequently, the support provided by the mattress assembly to the user. Moreover, by being able to easily adjust the firmness, a user can quickly match the firmness of the bed to their specific preferences and, at least partially, individualize his or her level of sleep comfort. Accordingly, a mattress assembly that makes use of one or more air bladders and further improves the individualized sleep comfort offered by current air bladder-based mattress assemblies would be both highly desirable and beneficial.

SUMMARY

The present invention relates to climate controlled mattress assemblies and methods for controlling the temperature of mattress assemblies. In particular, the present invention relates to mattress assemblies that make use of air bladders operably connected to an air pump and/or a climate control system for delivering heated or cooled air to one or more air bladders included in the mattress assemblies. Thus, the mattress assemblies of the present invention allow a user to individualize their level of comfort, including sleep comfort, by not only controlling the firmness of the mattress assembly, but also by controlling the temperature of mattress assembly.

In one exemplary embodiment of the present invention, a mattress assembly is provided that includes a body supporting portion having a first surface and a second surface opposite the first surface. The mattress assembly further includes one or more air bladders that are positioned adjacent to the second surface of the body supporting portion, and that are received by one or more wells defined by a bottom surface, a border, and an interior wall of a frame portion of a mattress assembly. The mattress assembly also includes an air pump operably connected to a climate control system for delivering heated or cooled air into the air bladder, as described in further detail below.

The body supporting portion and the frame of the mattress assembly are generally comprised of a flexible foam. The flexible foam comprising the frame is typically of a sufficient density and hardness for supporting the air bladders and the body supporting portion of the mattress assembly. The flexible foam comprising the body supporting portion, on the other hand, typically has a density less than that of the frame and is suitable for distributing pressure from a user's body, or portion thereof, across the body supporting portion. In some embodiments, the flexible foam included in the body supporting portion is a visco-elastic foam that has a desired density and hardness, and allows pressure to be absorbed uniformly and distributed evenly across the body supporting portion of the mattress assembly. In this regard, in certain embodiments, the body supporting portion of the mattress assembly can be further covered by a comfort layer that is positioned atop the body supporting portion to provide an additional level of comfort to a body of a user or a portion thereof that is resting on the mattress assembly. Such a comfort layer, in certain embodiments, is also comprised of a visco-elastic foam or other foam, but typically has a density that is less than that of the body supporting portion of the mattress assembly so as to provide a softer surface on which to rest, and so as to provide a sufficiently soft barrier between the body of a user and the air bladders of the mattress assembly.

With respect to the air bladders of the mattress assembly, the air bladders are positioned adjacent to the second surface of the body supporting portion and are configured to provide a desired amount of support to the body supporting portion of the mattress assembly. Further, in addition to being configured to provide a desired amount of support, the air bladders are also positioned and configured to selectively heat or cool the mattress assembly. For example, in some embodiments, the air bladders are positioned and configured in the mattress assembly such that, as heated or cooled air is delivered to the air bladders, heat dissipates into the air bladder when the body supporting portion has a temperature greater than that of the air bladder, or dissipates into the body supporting portion when the air bladder has a temperature greater than that of the body supporting portion.

With further respect to the air bladders of the mattress assembly, each air bladder is in fluid communication with an air pump that delivers air to each air bladder to facilitate the heating and cooling of the body supporting portion of the mattress assembly. In some embodiments, the air pump is operably connected to a climate control system that is placed in line with the air pump, such that air being delivered to the air bladder of the mattress assembly passes through the climate control system and is selectively heated or cooled prior to being introduced into the air bladder. In this regard, in some embodiments, the climate control system can include a plurality of thermoelectric elements, such as Peltier elements, that can be configured to heat or cool air passing through the climate control system.

In some embodiments, to provide an increased amount of support to a particular portion of the mattress assembly or to further control the temperature of a particular portion of the mattress assembly, multiple air bladders can be included in the mattress assembly, or the air bladders included in the mattress assembly can be further divided into discrete compartments. For example, in certain embodiments, a first air bladder and a second air bladder can be positioned adjacent to one another in the mattress assembly and can be used to selectively provide support and selectively control the temperature of opposite sides of the mattress assembly. In other embodiments, an air bladder included in a mattress assembly can be further divided into discrete compartments, such that each of the compartments can be used to selectively provide support to and to control the temperature of portions of the body supporting portion that would be in contact with a particular portion of the body of a user lying on the mattress assembly (e.g., the head, torso, or legs of a user). In some embodiments, to provide a greater amount of control over the support provided by the air bladders or the temperature control provided by the air bladders, each air bladder or each discrete compartment included in a single air bladder is independently controlled.

To further take advantage of the heating and cooling capabilities of the climate control system, in certain embodiments, the mattress assembly further includes a return conduit that returns heated or cooled air from the air bladder to the air pump such that air that has been previously heated or cooled and has undergone a limited amount of cooling or heating as a result of being introduced in the air bladder can be recirculated through the climate control system to maintain a more uniform temperature in the air bladder and prevent minor temperature fluctuations that may otherwise occur if ambient air were being continuously introduced in the climate control system via the air pump. In this regard, in some embodiments, a filter or air freshener cartridge can further be incorporated into the air pump the climate control system, or both to maintain a level of freshness in the recirculated air.

In other embodiments of the mattress assemblies of the present invention, one or more relief valves are further included in the air bladders and are in fluid communication with the interior of the air bladders so as to provide a means to release an amount of air present in the air bladder. By including a relief valve in fluid communication with the air bladder, rather than recirculating air that has been previously heated or cooled, an amount of air present in the air bladder can be released continuously or periodically from the relief valve and simply replaced with ambient air directly from the air pump or, in other embodiments, with heated or cooled air being delivered to the air bladder from the climate control system via the air pump.

Regardless of whether the air in an air bladder of an exemplary mattress assembly is recirculated or is continuously or periodically released from the air bladder, each mattress assembly of the present invention further includes a controller for controlling an amount of air supplied to the air bladder from the air pump, a temperature of the air supplied to the air bladder via the climate control system, or both. For example, in certain embodiments, the controller is configured to automatically control the amount of air supplied to the air bladder from the air pump, the temperature of the air supplied to the air bladder via the climate control system, or both, such that that the amount or temperature of the air supplied to the air bladder can automatically be adjusted when the pressure or temperature of the air in the air bladder reaches a particular level. As another example, the controller, in some embodiments, is configured to supply an amount or temperature of air to the air bladder for a predetermined period of time, such as for an 8-hour sleeping period or for a length of time that corresponds to the time a user usually spends in a specific stage of the sleep cycle (e.g., REM sleep).

To provide an additional level of control over the amount or temperature of the air present in the air bladders, in certain embodiments, the mattress assemblies further include one or more features that are operably connected to the body supporting portion, the air bladder, or both. Such features include pressure sensors that provide pressure feedback to the controller and allow the controller to automatically instruct the air pump to begin supplying air to the mattress when a user lies on the mattress or when the pressure of the air in the air bladder falls below a desired level. Temperature sensors can also be included in an exemplary mattress assembly and used to provide temperature feedback to the controller and allow the controller to instruct the climate control system of the mattress assembly to selectively heat or cool the air that is being supplied to the climate control system via the air pump in response to received temperature feedback and to maintain a desired temperature. Such desired temperature or pressure feedback settings are, in certain embodiments, directly inputted or adjusted at the controller itself or can be transmitted to the controller from a remote control that is also operably connected to the controller and allows a user to remotely adjust the firmness and temperature of the mattress assembly, or portions thereof.

With further regard to the mattress assemblies of the present invention, an exemplary mattress assembly can also be used as part of a method of controlling the temperature of the mattress assembly. In some implementations, a method of controlling the temperature of a mattress assembly comprises first providing a mattress assembly including a body supporting portion having a first surface and a second surface opposite the first surface, an air bladder positioned adjacent to the second surface of the body supporting portion, and a frame portion including a bottom surface and a border defining a well for receiving the air bladder. Air is then delivered into the air bladder of the mattress assembly, such that heat dissipates into the air bladder when the body supporting portion has a temperature greater than that of the air bladder, and such that heat dissipates into the body supporting portion when the air bladder has a temperature greater than that of the body supporting portion. In certain implementations, the step of delivering air into the air bladder comprises pumping an amount of air into the air bladder via an air pump in fluid communication with the air bladder, and then releasing a similar amount air from the air bladder via a relief valve that is also in fluid communication with the air bladder. In some implementations, the air pump is operably connected to a climate control system so as to deliver an amount of heated or cooled air into the air bladder, and thereby selectively heat or cool the mattress assembly, while also providing a desired amount of support to the body supporting portion of the mattress assembly.

Further features and advantages of the present invention will become evident to those of ordinary skill in the art after a study of the description, figures, and non-limiting examples in this document.

DESCRIPTION OF EXEMPLARY EMBODIMENTS

The present invention relates to climate controlled mattress assemblies and methods for controlling the temperature of mattress assemblies. In particular, the present invention relates to mattress assemblies that make use of air bladders operably connected to an air pump and/or a climate control system for delivering heated or cooled air to one or more air bladders included in the mattress assemblies. The air pump and climate control systems included in the mattress assemblies of the present invention thus allow a user to not only control the firmness of the mattress assemblies by controlling the amount of air delivered to the air bladders, but also the temperature of the mattress assemblies by controlling the temperature of the air that is introduced into and that is present within the air bladders. Thus, the mattress assemblies of the present invention allow a user to individualize their level of comfort, including sleep comfort, by not only controlling the firmness of the mattress assembly, but also by controlling the temperature of mattress assembly.

Figure 1:
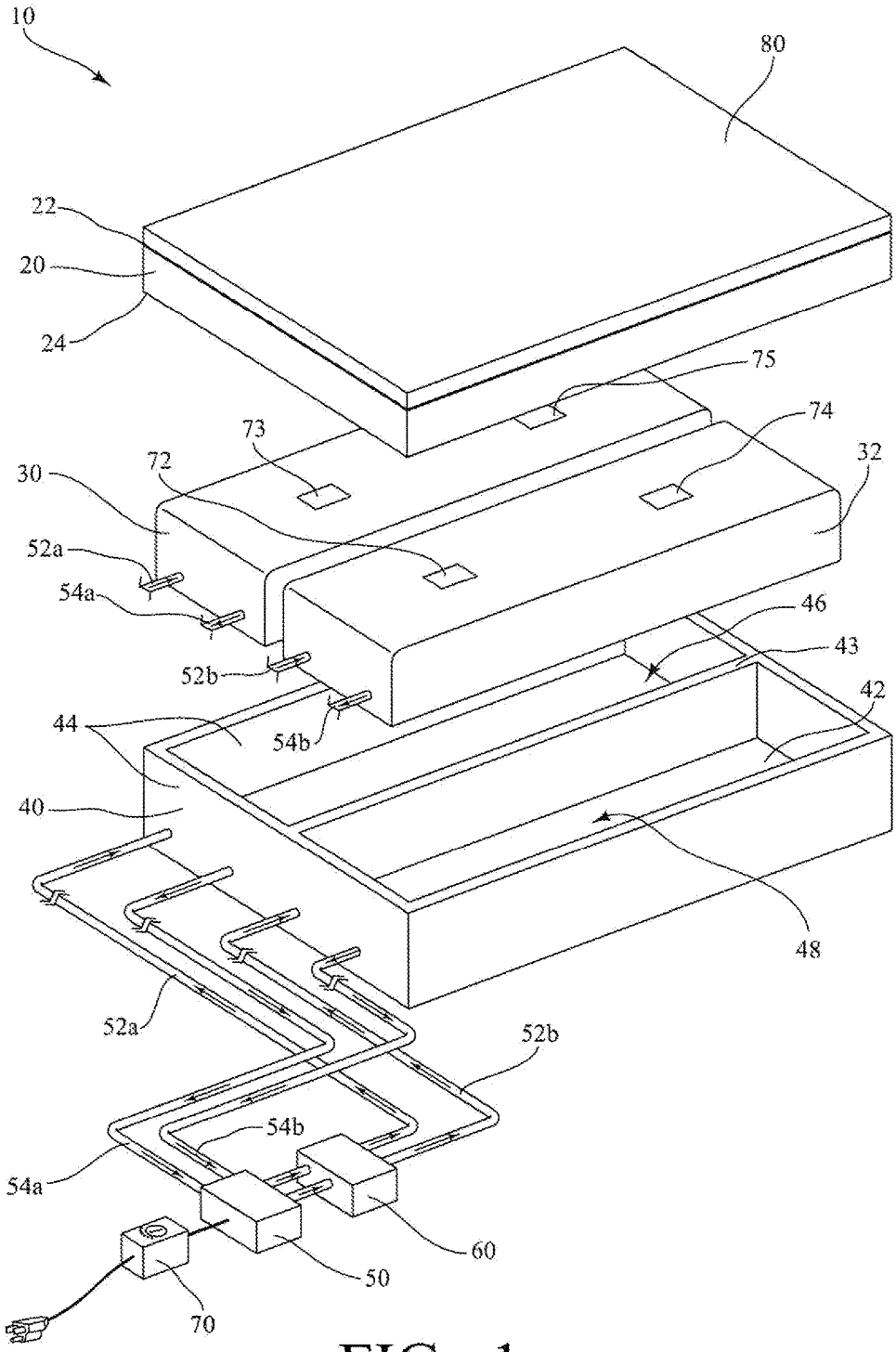
FIG. 1 is an exploded, perspective view of an exemplary mattress assembly made in accordance with the present invention.
Figure 2:
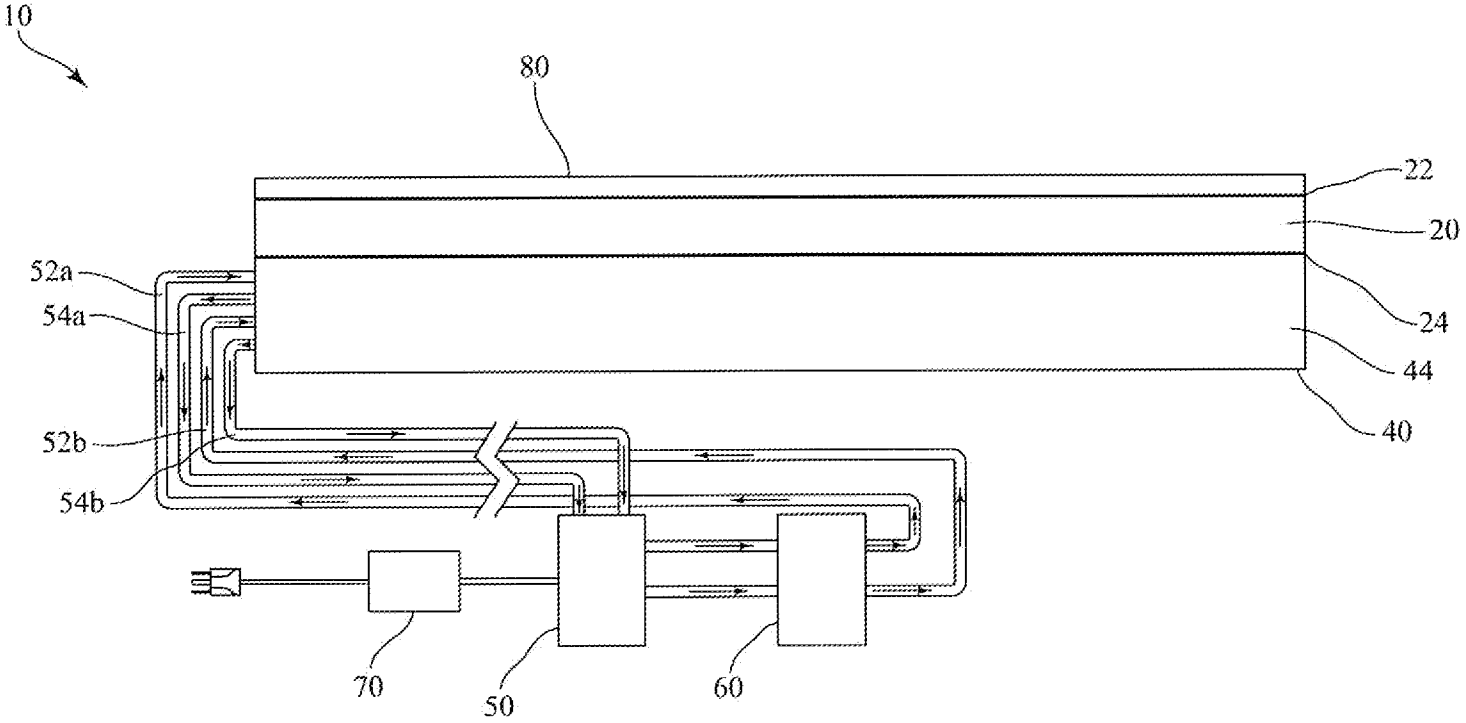
FIG. 2 is a schematic representation of the exemplary mattress assembly of FIG. 1, showing the mattress assembly in an assembled form.

Referring first to FIGS. 1-2, in one exemplary embodiment of the present invention, a mattress assembly 10 is provided that includes a body supporting portion 20 having a first surface 22, which is generally an upper surface of the mattress assembly, and a second surface 24, which is generally the lower surface of the body supporting portion 20 and is opposite the first surface 22. The mattress assembly further includes a first air bladder 30 and a second air bladder 32 that are positioned adjacent to the second surface 24 of the body supporting portion 20, and are dimensionally-sized such that the air bladders 30, 32 can be suitably received by a first well 46 and a second well 48, respectively, that are defined by a bottom surface 42, an interior wall 43, and a peripheral wall 44 of a frame 40 of the mattress assembly 10. The mattress assembly 10 also includes an air pump 50 operably connected to a climate control system 60 for delivering heated or cooled air into the air bladders 30, 32 via supply lines 52*a*, 52*b* that place the pump 50, the climate control system 60, and the air bladders 30, 32 in fluid communication with one another, as described in further detail below.

The body supporting portion 20 and the frame 40 of the mattress assembly 10 are generally comprised of a flexible foam. The flexible foam comprising the frame 40 is of a sufficient density and hardness for supporting the air bladders 30, 32 as well as the body supporting portion 20 of the mattress assembly 10. The flexible foam comprising the body supporting portion 20 of the mattress assembly 10, on the other hand, typically has a density less than that of the frame 40 and is suitable for distributing pressure from a user's body, or portion thereof, across the body supporting portion 20. Such flexible foams include, but are not limited to, latex foam, reticulated or non-reticulated visco-elastic foam (sometimes referred to as memory foam or low-resilience foam), reticulated or non-reticulated non-visco-elastic foam, polyurethane high-resilience foam, expanded polymer foams (e.g., expanded ethylene vinyl acetate, polypropylene, polystyrene, or polyethylene), and the like. In the embodiment shown in FIGS. 1-2, the body supporting portion 20 is comprised of a visco-elastic foam that has a low resilience as well as a sufficient density and hardness, which allows pressure to be absorbed uniformly and distributed evenly across the body supporting portion 20 of the mattress assembly 10. Generally, such visco-elastic foams have a hardness of at least about 10 N to no greater than about 80 N, as measured by exerting pressure from a plate against a sample of the material to a compression of at least 40% of an original thickness of the material at approximately room temperature (i.e., 21° C. to 23° C.), where the 40% compression is held for a set period of time as established by the International Organization of Standardization (ISO) 2439 hardness measuring standard. In some embodiments, the visco-elastic foam included in the body supporting portion 20 has a hardness of about 10 N, about 20 N, about 30 N, about 40 N, about 50 N, about 60 N, about 70 N, or about 80 N to provide a desired degree of comfort and body-conforming qualities.

The visco-elastic foam described herein for use in the mattress assembly 10 can also have a density that assists in providing a desired degree of comfort and body-conforming qualities, as well as an increased degree of material durability. In some embodiments, the density of the visco-elastic foam used in the body supporting portion 20 has a density of no less than about 30 kg/m$^3$ to no greater than about 150 kg/m$^3$. In some embodiments, the density of the visco-elastic foam used in the body supporting portion 20 of the mattress assembly 10 is about 30 kg/m$^3$, about 40 kg/m$^3$, about 50 kg/m$^3$, about 60 kg/m$^3$, about 70 kg/m$^3$, about 80 kg/m$^3$, about 90 kg/m$^3$, about 100 kg/m$^3$, about 110 kg/m$^3$, about 120 kg/m$^3$, about 130 kg/m$^3$, about 140 kg/m$^3$, or about 150 kg/m$^3$. Of course, the selection of a visco-elastic foam having a particular density will affect other characteristics of the foam, including its hardness, the manner in which the foam responds to pressure, and the overall feel of the foam, but it is appreciated that a visco-elastic foam having a desired density and hardness can readily be selected for a particular application or mattress assembly as desired. Additionally, it is appreciated that the body supporting portions of the mattress assemblies need not be comprised of a continuous layer of flexible foam at all, but can also take the form of more traditional mattresses, including spring-based mattresses, without departing from the spirit and scope of the subject matter described herein.

Referring still to FIGS. 1-2, the body supporting portion 20 of the mattress assembly 10 is further covered by a comfort portion or layer 80 that is positioned atop the body supporting portion 20 and provides a level of comfort to a body of a user or a portion of thereof that is resting on the mattress assembly 10. The comfort layer 80 can also be comprised of a visco-elastic foam. However, the comfort layer 80 typically has a density, hardness, err both that is less than that of the body supporting portion 20 of the mattress assembly 10, such that the comfort layer 80 provides a softer surface on which to rest the body of a user or a portion thereof, while also providing a sufficiently soft barrier between the body of a user and the air bladders 30, 32 of the mattress assembly 10, as described in further detail below. For example, in certain embodiments, the mattress assembly 10 includes a body supporting portion 20 that is comprised of visco-elastic foam with a density of about 80 kg/m$^3$ and a hardness of about 13 N, while the comfort layer 80 is comprised of a visco-elastic foam with a density of about 35 $kg/m^3$ and a hardness of about 10 N.

Regardless of the particular densities of the materials (i.e., the foams) used to produce the body supporting portion 20, the comfort layer 80, and the frame 40 of the mattress assembly 10, the body supporting portion 20, the comfort layer 80, and the frame 40 are generally secured to one another and, at least partially, to the air bladders 30, 32 to prevent the body supporting portion 20, the comfort layer 80, the frame 40, and the air bladders from unnecessarily moving relative to one another during use. Various means of securing one layer of material to another can be used in this regard, including tape, hook and loop fasteners, conventional fasteners, stitches, and the like. In one particular embodiment, the body supporting portion 20, the comfort layer 80, and the frame 40 are bonded together by an adhesive or cohesive bonding material. In one embodiment, the body supporting portion 20 and the comfort layer 80 are bonded together by an adhesive or cohesive bonding material to create a substantially continuous assembly where the body supporting portion 20 and the comfort layer 80 are fully adhered to one another. Such adhesive bonding materials include, for example, environmentally-friendly, water based adhesives, like SABA AQUABOND RSD, a two-component water-based adhesive product produced by SABA DINXPERLO BV, B-7090 AA, Dinxperlo, Belgium.

With further regard to the body supporting portions of the mattress assemblies of the present invention, as indicated above, the body supporting portions are generally comprised of one or more layers of visco-elastic foam having a density and hardness suitable for distributing pressure from a user's body, or portion thereof. However, it is additionally contemplated that an exemplary body supporting portion can be further comprised of one or more different or additional layers having various densities and hardnesses. For instance, it is contemplated that a layer of high-resilience polyurethane foam can be secured to the second surface of a layer of low-resilience visco-elastic foam used in a body supporting portion. Such multi-layered body supporting portions are described, for example, in U.S. Pat. Nos. 7,469,437; 7,507,468; 8,025,964; and 8,034,445, as well as in U.S. Patent Application Publication No. 2011/0252562, each of which is incorporated herein by this reference.

Turning now to the air bladders included in the mattress assemblies of the present invention, and referring still to FIGS. 1-2, the air bladders 30, 32 of the mattress assembly 10 are positioned adjacent to the second surface 24 of the body supporting portion 20 and are, upon delivering a desired amount of air to the air bladders 30, 32, thus positioned and configured to provide a desired amount of support to the body supporting portion 20 of the mattress assembly 10. Further, in addition to being configured to provide a desired amount of support, the air bladders 30, 32 are also positioned and configured to selectively heat or cool the body supporting portion 20 of the mattress assemblies 10. In this regard, by positioning the air bladders 30, 32 adjacent to the second surface 24 of the body supporting portion 20, the air bladders 30, 32 are positioned and configured in the mattress assembly 10 such that as heated or cooled air is delivered to the air bladders 30, 32, heat dissipates into the air bladders 30, 32 when the body supporting portion 20 has a temperature greater than that of the air bladders 30, 32, or dissipates into the body supporting portion when the air bladders 30,32 have a temperature greater than that of the body supporting portion 20. As such, the air bladders 30, 32 allow, at least in part, the body supporting portion 20 of the mattress assembly 10 to be selectively heated and cooled without requiring a separate cold or heat source to be incorporated into the mattress assembly 10 to cool or heat the body supporting portion 20 of the mattress assembly 10.

With further respect to the heating and cooling provided by the air bladders 30, 32 of the mattress assembly 10, and as indicated above, each air bladder 30, 32 is in fluid communication with an air pump 50 operably connected to a climate control system 60 for delivering heated or cooled air into the air bladders 30, 32 via supply lines 52*a*, 52*b* that place the pump 50, the climate control system 60, and the air bladders 30, 32 in fluid communication with one another. In this regard, various climate control systems can be incorporated into the mattress assembly 10 and used to selectively heat or cool air that is being delivered into the air bladders 30, 32 of the mattress assembly 10 via the air pump 50. Additionally, such climate control systems can make use of a number of devices for heating or cooling an amount of air, including, but not limited to, air-to-air heat exchangers, thermoelectric elements such as resistive heaters that convert electrical energy to heat, or Peltier elements that transfer heat from one side of the Peltier element to the other by flowing an amount of electrical current through the Peltier elements to produce a Peltier effect. For example, in some embodiments, the climate control system is a Peltier-based Thermoelectric Module, such as those provided by Tempronics Inc., Tucson, Ariz.

As shown in FIG. 1, to further take advantage of the heating and cooling capabilities of the climate control system 60 and the air bladders 30, 32 of the mattress assembly, the first air bladder 30 and the second air bladder 32 are positioned on opposite sides of the mattress assembly 10, such that the first air bladder 30 and the second air bladder 32 can be positioned adjacent to one another in the mattress assembly 10 and used to selectively provide support and selectively control the temperature of opposite sides of the body supporting portion 20 of the mattress assembly 10. In this regard, each air bladder 30, 32 of the mattress assembly 10 can be used to selectively support and selectively heat or cool the body of a user lying in a supine or prone position on the mattress assembly 10. For example, and as described in further detail below, in some embodiments, the air bladders 30, 32 are individually addressable, such that it is possible to cool the air bladder 30 and provide a minimum level of support to a user lying on one side of the body supporting portion 20 of the mattress assembly 10, while heating the air bladder 32 and providing a maximum amount of support to a user lying on the opposite side of the body supporting portion 20 of the mattress assembly 10.

Figure 3:
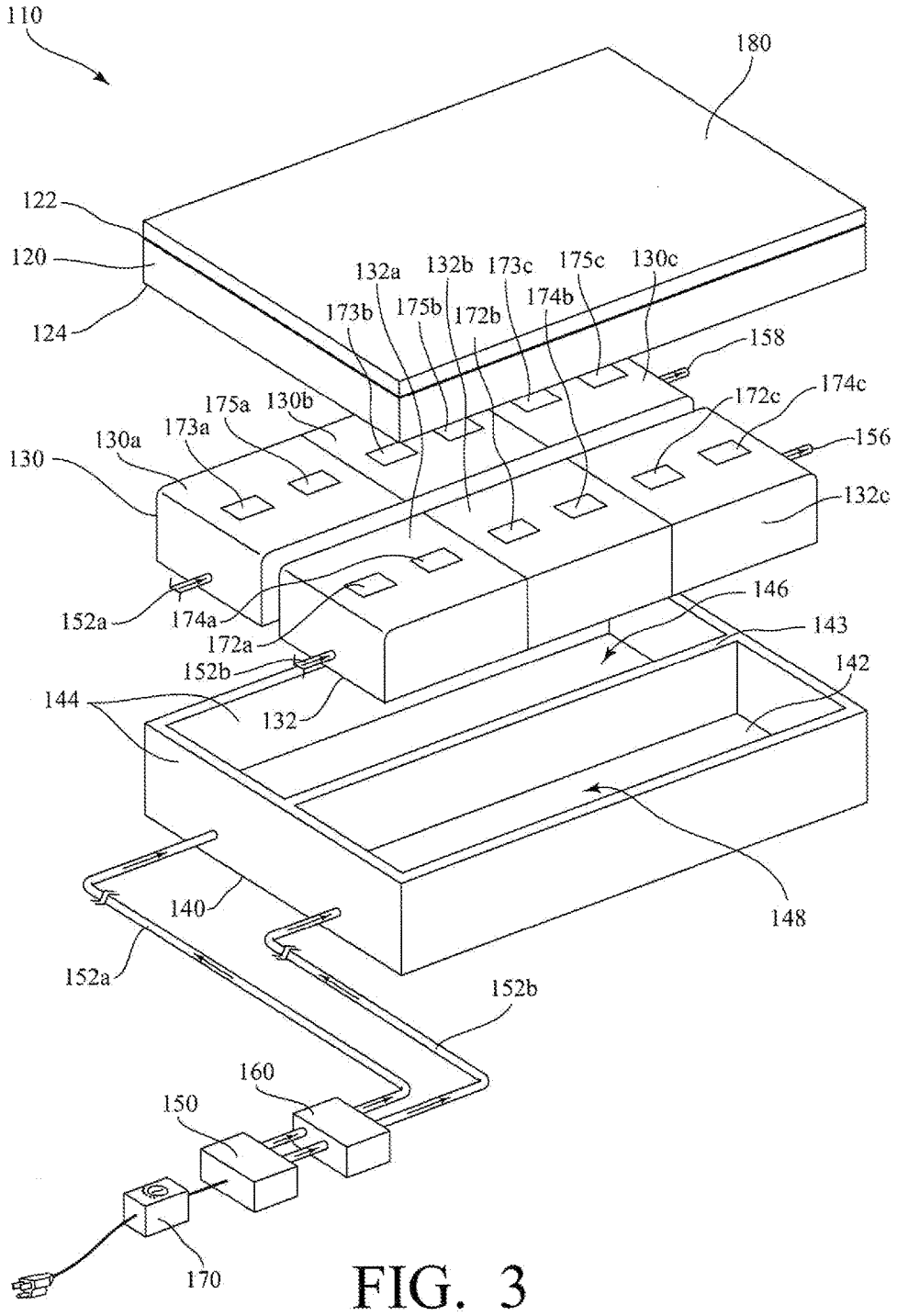
FIG. 3 is an exploded, perspective view of another exemplary mattress assembly made in accordance with the present invention, and including two air bladders with three discrete compartments and relief valves for releasing air from the air bladders of the mattress assembly.
Figure 4:
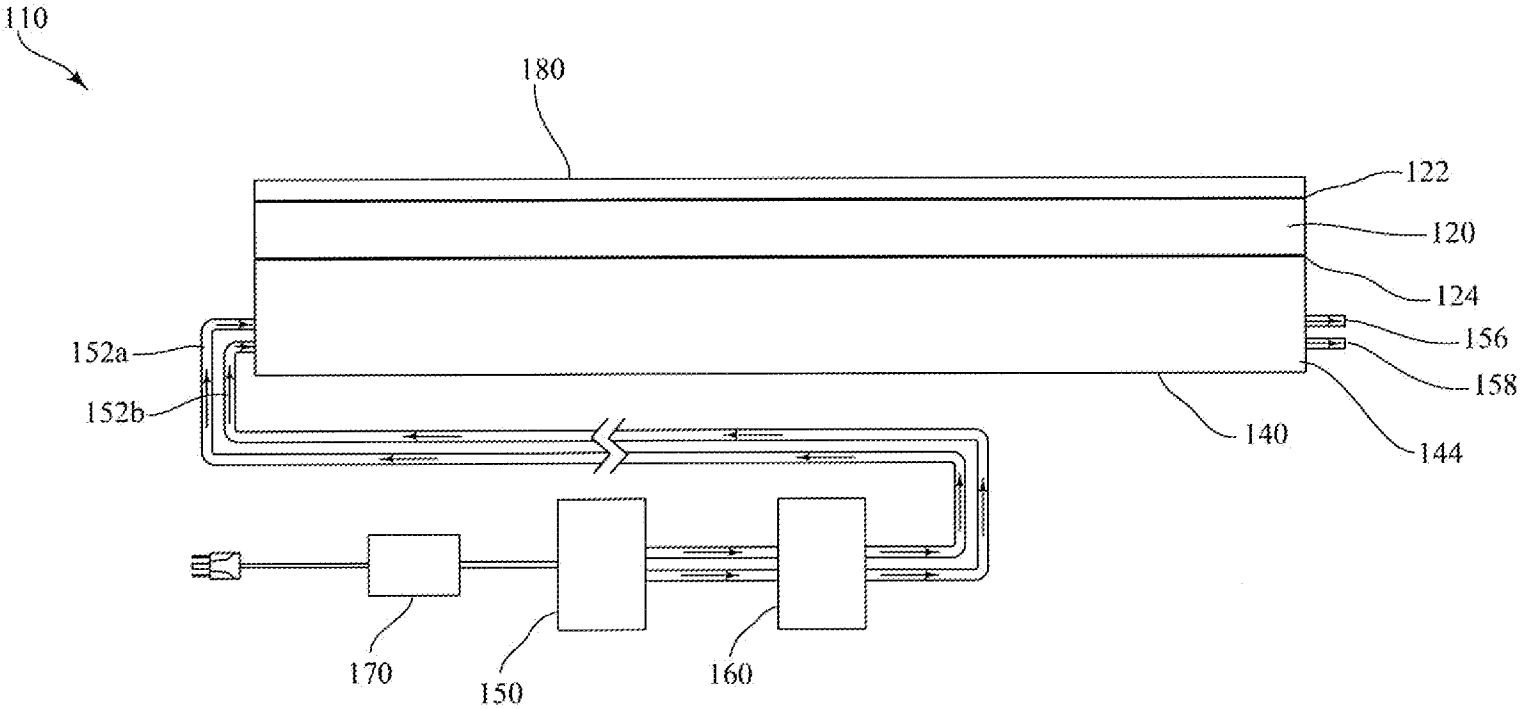
FIG. 4 is a schematic representation of the exemplary mattress assembly of FIG. 3, showing the mattress assembly in an assembled form.

As a further refinement to the customized support and heating and cooling capabilities offered by the mattress assemblies of the present invention, and referring now to FIGS. 3-4, in another embodiment, a mattress assembly 110 is provided that, like the mattress assembly 10 shown in FIGS. 1-2, includes a body supporting portion 120 having a first surface 122 and a second surface 124 opposite the first surface 122, and a comfort layer 180. The mattress assembly 110 further includes a first air bladder 130 and a second air bladder 132 that are positioned adjacent to the second surface 124 of the body supporting portion 120. Moreover, the mattress assembly also includes a first well 146 and a second well 148 that are defined by a bottom surface 142, an interior wall 143, and a peripheral wall 144 of a frame 140 of the mattress assembly 110. The mattress assembly 110 additionally includes an air pump 150 that is operably connected a climate control system 160 for delivering heated or cooled air into the air bladders 130, 132 via supply lines 152*a*, 152*b*. Unlike the mattress, assembly 10 shown in FIGS. 1-2, however, to provide an increased amount of support to a particular portion of the mattress assembly 110 or to further control the temperature of a particular portion of the mattress assembly 110, the air bladders 130, 132 are further divided into discrete compartments 130*a*, 130*b*, 130*c*, 132*a*, 132*b*, 132*c*, such that the positioning of the discrete compartments 130*a*, 130*b*, 130*c*, 132*a*, 132*b*, 132*c* corresponds to certain areas of the body supporting portion 120 and allows greater control over the firmness and temperature of the mattress assembly 110 in those areas of the body supporting portion 120. For example, in some embodiments, the compartments 130*a*, 130*b*, 130*c*, 132*a*, 132*b*, 132*c* are individually addressable such that it is possible to provide an increased amount of cooled air to the compartments 130*a*, 130*b*, 132*a*, 132*b* that would be in proximity to the head and torso of a person lying in a supine or prone position on the mattress assembly 110, while providing a decreased amount of heated air to the compartments 130*c*, 132*c* that would be proximity to the legs of a user lying in a supine or prone position. By providing an increased amount of cooled air to the compartments 130*a*, 130*b*, 132*a*, 132*b* that would be in proximity to the head and torso of a person and a decreased amount of heated air to the compartments 130*c*, 132*c* that would be in proximity to the legs of a user, the air bladders 130, 132 can thus effectively be used to selectively heat or cool and selectively provide support to particular portions of a body of a user that are prone to excessive heating or cooling or that require more or less support (e.g., the head or torso of a user vs. the legs of a user).

To further take advantage of the heating and cooling capabilities of the climate control systems included in the mattress assemblies of the present invention, and referring again to FIGS. 1 and 2, in certain embodiments, the mattress assembly 10 further includes return conduits 54*a*, 54*b* that return heated or cooled air from the air bladders 30, 32 to the climate control system 60 and the air pump 50. In such an embodiment, air that has been previously heated or cooled, and has then undergone a limited amount of cooling or heating as a result of being introduced into the air bladders 30, 32 is recirculated through the climate control system 60 to maintain a more uniform temperature in the air bladders 30, 32 and to prevent minor temperature fluctuations that may otherwise occur if ambient air was being continuously introduced into the climate control system 60 via the air pump 50 and was then being introduced into the air bladders 30, 32. In this regard, although not shown in FIGS. 1-2, it is appreciated that a filter or air freshener cartridge can further be incorporated into the air pump 50, the climate control system 60, or both to maintain a level of freshness of the air that is being circulated through the air pump 50, the climate control system 60, the supply lines 52*a*, 52*b*, the air bladders, 30, 32, and the return conduits 54*a*, 54*b*.

As another refinement to heating and cooling capabilities of the mattress assemblies of the present invention and referring again to FIGS. 3-4, in certain embodiments, rather than including return conduits in the mattress assembly 110, relief valves 156, 158 are further included in the air bladders 130, 132 and are in fluid communication with the interior of the air bladders 130, 132 so as to provide a means to release an amount of air present in the air bladders 130, 132. By including the relief valves 156, 158 in the air bladders 130, 132 instead of recirculating air through the air bladders 132, 134, an amount of air present in the air bladders 130, 132 can be released continuously or periodically from the relief valves 156, 158 and a similar amount of heated or cooled air can then be delivered to the air bladders 130, 132 from the climate control system 160 and the air pump 150 to thereby replace the air that was previously released through the relief valves 156, 158 with newly heated or cooled air.

Figure 5:
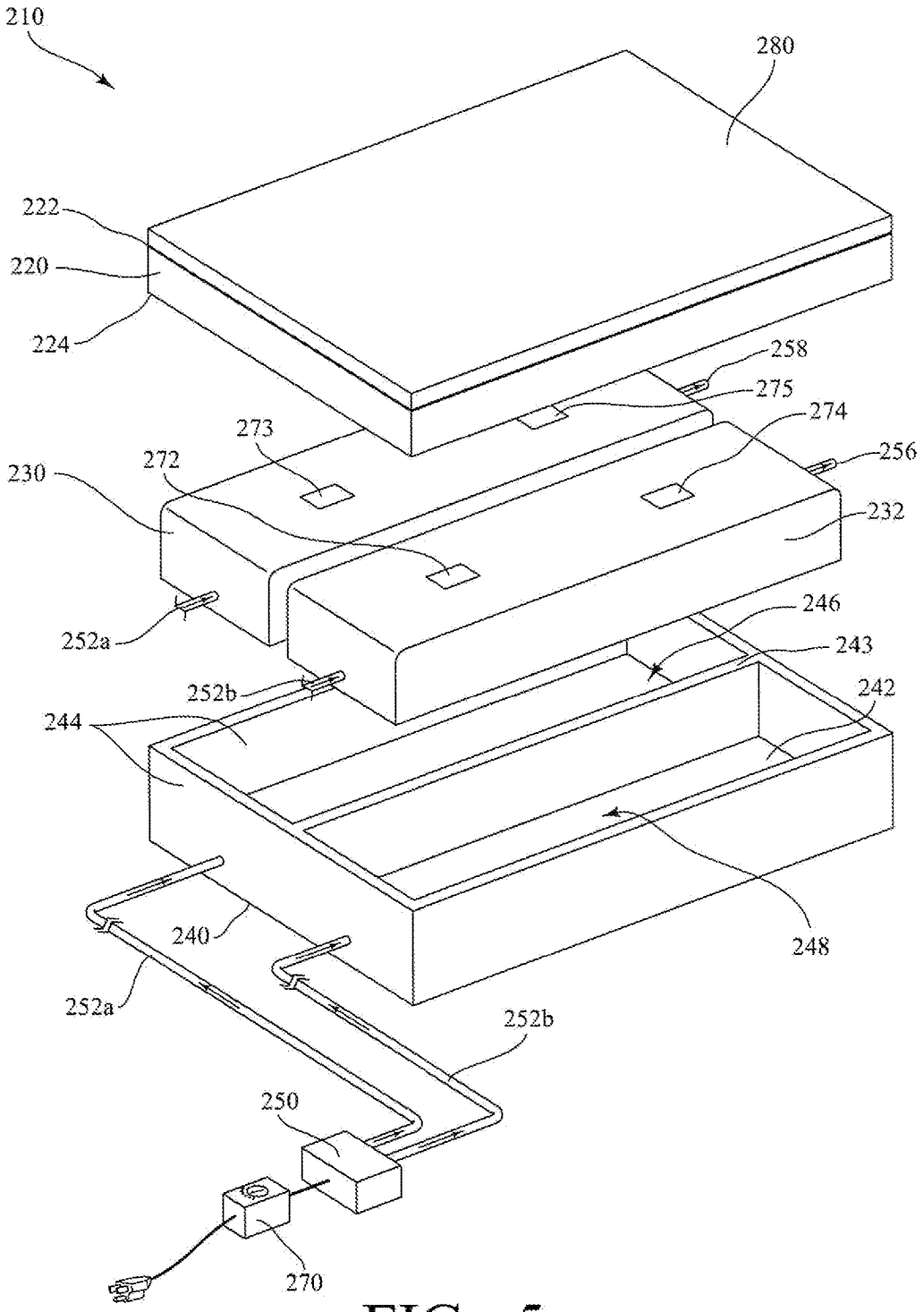
FIG. 5 is an exploded, perspective views of yet another exemplary mattress assembly made in accordance with the present invention, and including an air pump for supplying ambient air to the air bladders of the mattress assembly.
Figure 6:
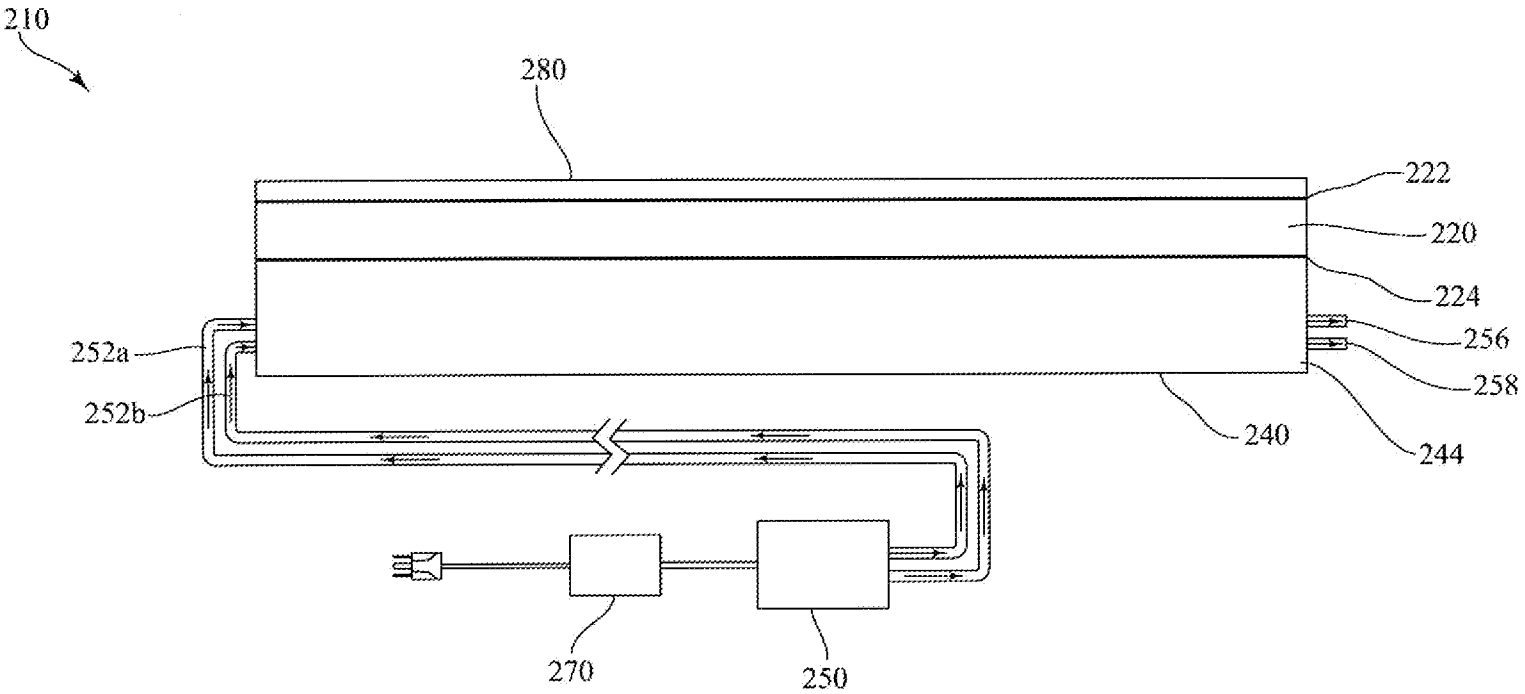
FIG. 6 is schematic representation of the exemplary mattress assembly of FIG. 5, showing the mattress assembly in an assembled form.

As yet another refinement, in another embodiment of the present invention that makes use of relief valves for releasing an amount of air from air bladders of the mattress assemblies, and referring now to FIGS. 5-6, an exemplary mattress assembly 210 is provided that includes: a body supporting portion 220 having a first surface 222 and a second surface 224 opposite the first surface 222; a comfort layer 280; a first air bladder 230 and a second air bladder 232 that are positioned adjacent to the second surface 224 of the body supporting portion 220; and a first well 246 and a second well 248 defined by a bottom surface 242, an interior wall 243, and a peripheral wall 244 of a frame 240 of the mattress assembly 210. The mattress assembly 210 also includes an air pump 250 for delivering air into the air bladders 230, 232 via supply lines 252*a*, 252*b*. Unlike the mattress assembly 110 shown in FIGS. 3-4, however, the mattress assembly 210 does not make use of a climate control system for delivering heated or cooled air to the air bladders 230, 232. Rather, in the mattress assembly 210, ambient air is pumped directly into the air bladders 230, 232 via the air pump 250 and is continuously or periodically released through the relief valves 256, 258, such that temperature of the mattress assembly 210 is maintained at the same temperature as the surrounding environment.

Regardless of whether the air in the air bladders 30, 32, 130, 132, 230, 232 of the exemplary mattress assemblies 10, 110, 210 described above with reference to FIGS. 1-6 is recirculated or is continuously or periodically released from the air bladders 30, 32, 130, 132, 230, 232, each mattress assembly 10, 110, 210 further includes a controller 70, 170, 270 for controlling an amount of air supplied to the air bladders 30, 32, 130, 132, 230, 232 from the air pumps 50, 150, 250, a temperature of the air supplied to the air bladders 30, 32, 130, 132 via the climate control systems 60, 160, or both. By including a controller 70, 170, 270 in the mattress assemblies 10, 110, 210, the controller 70, 170, 270 can be configured to automatically control the amount of air supplied to the air bladders 30, 32, 130, 132, 230, 232 from the air pumps 50, 150, 250, the temperature of the air supplied to the air bladders 30, 32, 130, 132 via the climate control system 60, 160, or both, such that that the amount or temperature of the air supplied to the air bladders 30, 32, 130, 132, 230, 232 can automatically be adjusted when the pressure or temperature of the air in the air bladders 30, 32, 130, 132, 230, 232 reaches a particular level. Additionally, by including a controller 70, 170, 270 in the mattress assemblies 10, 110, 210, the controller 70, 170, 270 can be configured to supply an amount or temperature of air to the air bladders 30, 32, 130, 132, 230, 232 for a predetermined period of time, such as for an 8-hour sleeping period or for a length of time that corresponds to the time a user usually spends in a specific stage of the sleep cycle (e.g., REM sleep). For instance, it is appreciated that during REM (rapid eye movement) sleep, a user generally loses at least some of their ability to control the temperature of his or her body. As such, in certain embodiments, the controllers 70, 170, 270 can be configured to instruct the air pumps 50, 150, 250, the climate control systems, 60, 160, or both to begin supplying cooled air to the air bladders 30, 32, 130, 132, 230, 232 of the mattress assemblies 10, 110, 210 at a time during the course of a night's sleep when a user would generally be in REM sleep. Alternatively, the controllers 70, 170, 270 can further be operably connected to a device that monitors sleep rhythms, such as, for example, the ZEO SLEEP MANAGER™ manufactured by ZEO, Newton, Mass., such that the controllers 70, 170, 270 can be configured to instruct the air pumps 50, 150, 250, the climate control systems 60, 160, or both, to begin supplying air, including cooled or heated air, to the air bladders 30, 32, 130, 132, 230, 232 of the mattress assemblies 10, 110, 210 upon receiving input that the user lying on the mattress assembly 10, 110, 210 has entered a particular stage of the sleep cycle (e.g., REM sleep).

As a further refinement, and as shown in FIGS. 1, 3, 5, and 8, to provide an additional level of control over the amount or temperature of the air present in the air bladders 30, 32, 130, 132, 230, 232, the mattress assemblies 10, 110, 210 are provided with pressure sensors 74, 75, 174*a*, 174*b*, 174*c*, 175*a*, 175*b*, 175*c*, 274, 275 that provide pressure feedback to the controllers 70, 170, 270 and allow the controllers 70, 170, 270 to automatically instruct the air pumps 50, 150, 250 to begin supplying air to air bladders 30, 32, 130, 132, 230, 232, including the discrete compartments 132*a*, 132*b*, 132*c*, 134*a*, 134*b*, 134*c* of the mattress assembly 110, when a user lies on the mattress assemblies 10, 110, 210 or when pressure of the air in the air bladders 30, 32, 130, 132, 230, 232, or a particular compartment 132*a*, 132*b*, 132*c*, 134*a*, 134*b*, 134*c*, falls below a desired level.

Figure 7:
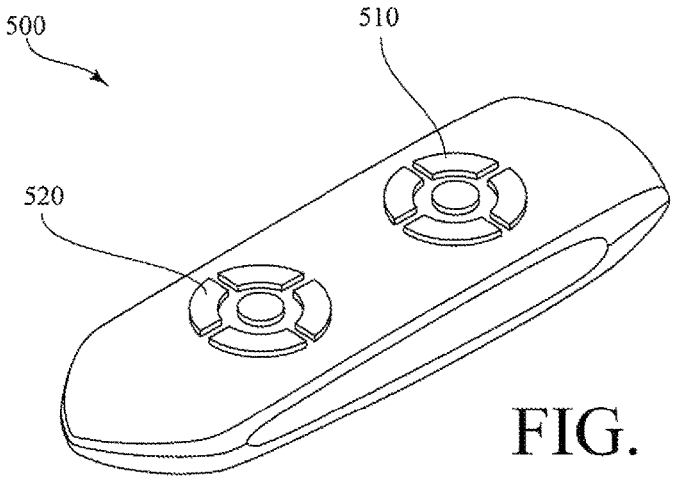
FIG. 7 is a perspective view of an exemplary remote control for controlling the temperature and firmness of a mattress assembly made in accordance with the present invention.
Figure 8:
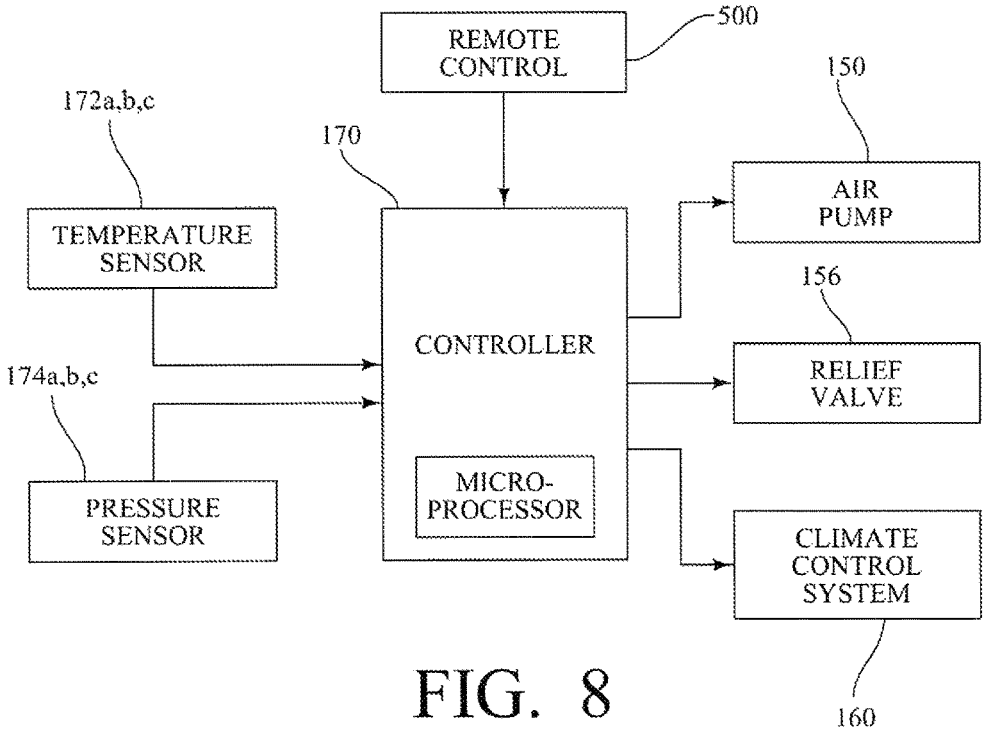
FIG. 8 is a schematic diagram showing the communication between temperature sensors, pressure sensors, the controller, a remote control, the air pump, a relief valve, and the climate control system of the mattress assembly of FIG. 3.

For another example and as also shown in FIGS. 1, 3, 5, and 8, temperature sensors 72, 73, 172*a*, 172*b*, 172*c*, 173*a*, 173*b*, 173*c*, 272, 273 are included in the mattress assemblies 10, 110, 210 and provide temperature feedback to the controllers 70, 170, 270 to allow the controllers 70, 170, 270 to instruct the air pumps 50, 150, 250 and/or the climate control systems 60, 160, 260 of the mattress assemblies 10, 110, 210 to begin supplying air or, more particularly, to begin selectively providing heated or cooled air in response to received temperature feedback and to maintain a desired temperature. Such desired temperature or pressure feedback settings can be directly inputted or adjusted at the controllers 70, 170, 270 or can be transmitted to the controllers 70, 170, 270 from a remote control 500, that includes temperature control buttons 510 and support control buttons 520, as shown in FIG. 7. In this regard, and as shown in FIG. 8, the remote control is also operably connected to the controllers 70, 170, 270 to allow a user to remotely adjust the temperature and firmness of the mattress assemblies 10, 110, 210, or portions thereof, as desired.

With further regard to the mattress assemblies of the present invention, an exemplary mattress assembly can also be used as part of a method of controlling the temperature of the mattress assembly. In some implementations, a method of controlling the temperature of a mattress assembly comprises first providing a mattress assembly including a body supporting portion having a first surface and a second surface opposite the first surface, an air bladder positioned adjacent to the second surface of the body supporting portion, and a frame portion including a bottom surface and a border defining a well for receiving the air bladder. Air is then delivered into the air bladder of the mattress assembly, such that heat dissipates into the air bladder when the body supporting portion has a temperature greater than that of the air delivered to the air bladder, and such that heat dissipates into the body supporting portion when the air delivered to the air bladder has a temperature greater than that of the body supporting portion. In certain implementations, delivering air into the air bladder to control the temperature of the mattress assembly is accomplished by pumping an amount of air into the air bladder via an air pump that is in fluid communication with the air bladder and then releasing a similar amount air from the air bladder via a relief valve that is also in fluid communication with the air bladder. In some implementations, to control the temperature of the mattress assembly, the air pump is operably connected to a climate control system that is then used to deliver an amount of heated or cooled air into the air bladder, and thereby selectively heat or cool the mattress assembly, while also providing a desired amount of support to the body supporting portion of the mattress assembly.

One of ordinary skill in the art will recognize that additional embodiments or implementations are possible without departing from the teachings of the present invention or the scope of the claims which follow. This detailed description, and particularly the specific details of the exemplary embodiments and implementations disclosed herein, is given primarily for clarity of understanding, and no unnecessary limitations are to be understood therefrom, for modifications will become obvious to those skilled in the art upon reading this disclosure and may be made without departing from the spirit or scope of the claimed invention.

What is claimed is:

1. A method of controlling the temperature of a mattress assembly, comprising:

providing a mattress assembly including a body supporting portion having a first surface and a second surface opposite the first surface, an air bladder positioned adjacent to the second surface of the body supporting portion, and a frame portion including a bottom surface and a border defining a well for receiving the air bladder; and delivering air into the air bladder, such that heat dissipates into the air bladder when the body supporting portion has a temperature greater than that of the air bladder, and such that heat dissipates into the body supporting portion when the air bladder has a temperature greater than that of the body supporting portion.

2. The method of claim 1, wherein the step of delivering air into the air bladder comprises pumping air into the air bladder via an air pump in fluid communication with the air bladder.

3. The method of claim 2, wherein the mattress assembly further comprises a relief valve operably connected to the air bladder for releasing air from the air bladder.

4. The method of claim 3, wherein the step of delivering air to the air bladder comprises continuously pumping air into the air bladder via the air pump and continuously releasing air from the air bladder via the relief valve.

5. The method of claim 3, wherein the step of delivering air to the air bladder comprises pumping an amount of air into the air bladder via the air pump and releasing a similar amount of air from the air bladder via the relief valve.

6. The method of claim 2, wherein the air pump is operably connected to a climate control system for delivering heated or cooled air into the air bladder.

7. The method of claim 6, further comprising a return conduit for returning air from the air bladder to the air pump.

* * * * *